US006793097B2

(12) United States Patent
Kamenstein

(10) Patent No.: US 6,793,097 B2
(45) Date of Patent: Sep. 21, 2004

(54) DISPENSER FOR ROLLED MATERIALS

(75) Inventor: Matthew Kamenstein, New York, NY (US)

(73) Assignee: Lifetime Hoan Corporation, Westbury, NY (US)

( * ) Notice: Subject to any disclaimer, the term of this patent is extended or adjusted under 35 U.S.C. 154(b) by 7 days.

(21) Appl. No.: 10/335,420

(22) Filed: Dec. 31, 2002

(65) Prior Publication Data

US 2004/0124304 A1 Jul. 1, 2004

(51) Int. Cl.[7] ..... B65H 1/00
(52) U.S. Cl. ..... 221/33; 242/597.7
(58) Field of Search ..... 221/33, 45, 277; 242/419, 419.8, 419.9, 597.7

(56) References Cited

U.S. PATENT DOCUMENTS 4,184,647 A * 1/1980 Rourke ..... 242/423
4,720,053 A 1/1988 Vance ..... 242/55.54
5,297,750 A 3/1994 Hunt ..... 242/55.54
5,651,487 A 7/1997 Hansen ..... 225/106
5,799,895 A 9/1998 Michaud et al. ..... 242/423
6,302,348 B1 10/2001 Lillelund et al. ..... 242/422.5
2002/0070308 A1 6/2002 Fahringer ..... 242/423.2

* cited by examiner

*Primary Examiner*—Kenneth Noland
(74) *Attorney, Agent, or Firm*—Jenkens & Gilchrist, P.C.

(57) ABSTRACT

A rotation mechanism is provided for use with dispensers for rolled products. The rotation mechanism can be utilized with dispensers configured for a number of different paper, plastic, foil or other products supplied as rolled sheets on tubes or rolls, The rotation mechanism provides mild resistance to the rotation of a roll of products such that a desired quantity can be removed from the roll without excess material unraveling from the roll.

33 Claims, 7 Drawing Sheets

DISPENSER FOR ROLLED MATERIALS

FIELD OF THE INVENTION

The present invention is drawn generally to the field of holders for paper, plastic, foil or other goods. More specifically, the present invention is drawn to the field of dispensers for paper, plastic, foil or other goods that are supplied as sheets on rolls.

BACKGROUND OF THE INVENTION

A number of household paper, plastic and foil goods in common use are supplied as continuous sheets on rolls or tubes. The most common examples of these are paper towels, toilet paper, plastic wrap and aluminum foil. In a number of cases the sheets are perforated at regular intervals to allow an individual to select a desired quantity of material and easily separate it from the roll. Dispensing of these materials is made even easier by a variety of dispensing devices that are used to mount the roll or tube on dowel or rod to allow easy unraveling of the sheets from the roll. A drawback of most dispensers is that because the roll of product is allowed to rotate freely, the force required to separate individual sheets from the roll frequently results in excess material being unraveled from the roll.

It would be desirable to provide a dispenser for rolled paper, plastic, foil or other products that eliminates these drawbacks. Such a device would be adaptable to various types of paper, plastic, foil and other goods that are supplied on rolls.

SUMMARY OF THE INVENTION

The present invention provides a novel rotation mechanism for use with a dispenser for paper, plastic, foil and other goods that are supplied on rolls or tubes as perforated or un-perforated sheets. The present invention further provides several embodiments of a dispenser for such products that incorporate the novel rotation mechanism of the current invention. One embodiment of the dispenser comprises a rod and a base for supporting a roll of material to be dispensed. A rotation mechanism located on the rod includes a spinner that is disposed on and rotatable about a sleeve affixed to the rod. A stationary friction disc disposed below the spinner supplies resistance to the rotation of the spinner and hence the roll on which the goods are supplied. While allowing rotation of the spinner to dispense the paper, plastic, foil, or other goods from the roll, the friction disc prevents the material from unraveling from the roll when a desired quantity is torn from the roll. The roll is maintained in mechanical contact with the spinner by a plurality of flexible bowing wires extending from the spinner to a cap located on the rod toward the end of the rod opposite the spinner. A preferred embodiment of the invention is designed for use with rolled paper products such as paper towels, toilet paper, etc.

In an alternate embodiment, the spinner is sized and configured to closely engage the inner surface of the tube or roll on which the goods are supplied, and the wires are not present.

DETAILED DESCRIPTION OF THE INVENTION

The present invention provides a novel rotation mechanism for a dispenser for paper, plastic, foil or other products that are supplied as perforated or un-perforated sheets on a tube or roll, and several embodiments of dispensers incorporating the novel rotation mechanism. According to one embodiment, the dispenser includes a rod having an axial screw stud at one end for joining the rod to a base member by means of a locking nut or similar connection in the base member. The rotation mechanism in this embodiment includes a sleeve disposed on the end of the rod that is joined to the base. Preferably the sleeve has a circumferential collar for retaining a spinner on the rod. A spinner is disposed on and freely rotatable about said sleeve. The top end of the spinner contacts the collar such that the spinner is retained on the sleeve. The bottom end of the spinner has a concentric depression therein, with a plurality of circumferential ridges. A friction disc is disposed on the axial screw stud and within the concentric depression on the bottom end of the spinner. The friction disc serves to retain the spinner on the sleeve. The friction disc also acts to generate mild resistance to the rotation of the spinner. This mild resistance allows the spinner to rotate to dispense a desired quantity of material from the roll on the rod. However, the resistance is sufficient to prevent undesired quantities of material from unraveling when a sheet is tom from the roll. An embodiment of the invention will now be described in detail with reference to the attached figures.

Figure 1:
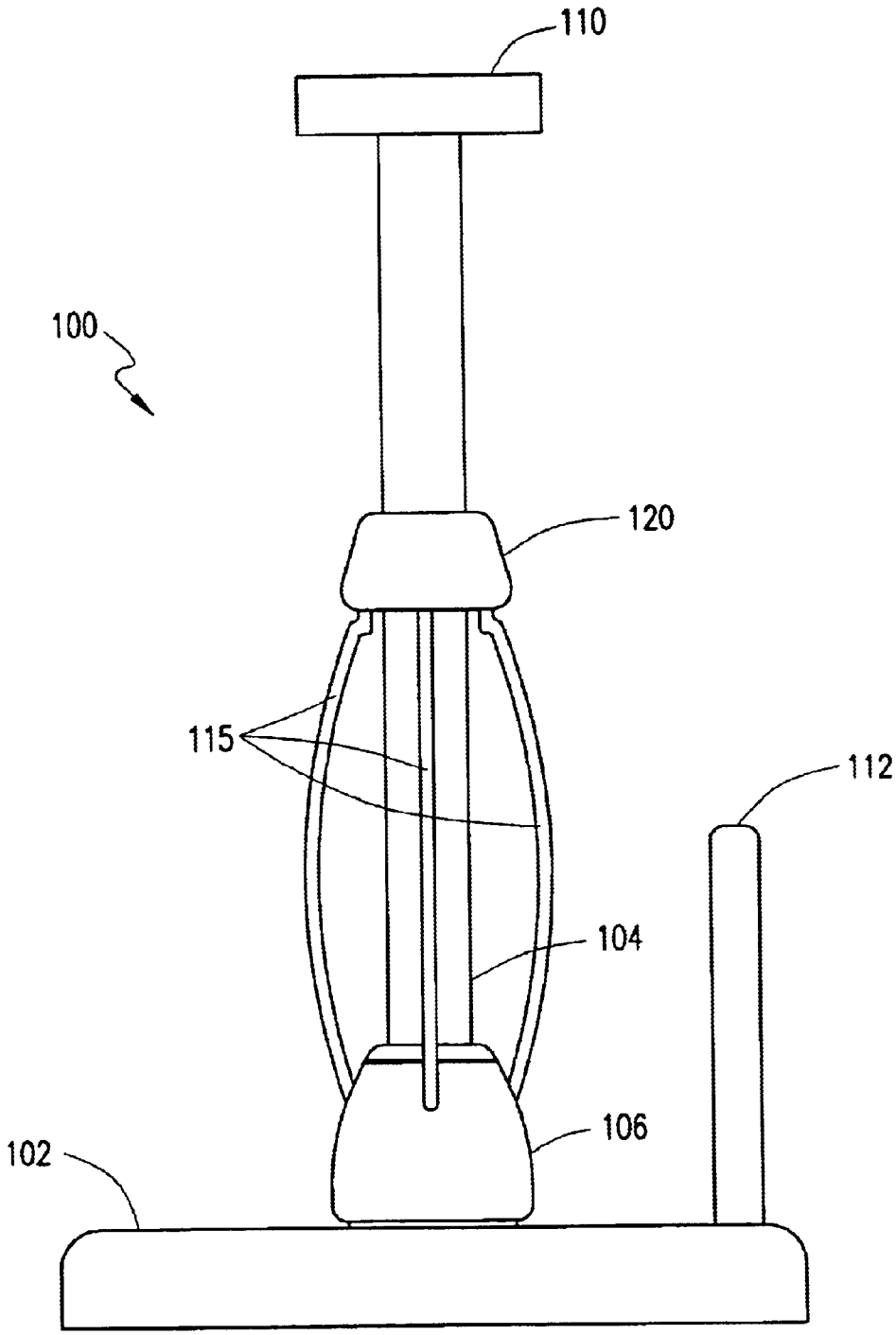
FIG. 1 illustrates a perspective view of a preferred embodiment of a dispenser incorporating a rotation mechanism according to the current invention.

Referring to FIG. 1, a preferred embodiment of the inventive dispenser is shown. The dispenser 100 is supported by a base 102, which is preferably weighted in the embodiment shown. A rod 104 extends vertically from the base 102. A spinner 106 is located at one end of the rod 104, preferably proximate, to the base 102 as shown in FIG. 1. A cap 120 is located on the rod 104 toward the end opposite the location of the spinner 106. A plurality of flexible wires 115 are connected at one end to the cap 120 and at the other end to the spinner 106. The wires bow outward and provide a snug fit to the inside of the roll of sheets being dispensed. The wires thus ensure that the roll, cap, and spinner all rotate together as a unit, e.g., a rotation mechanism, with no slippage of the roll with respect to the rotation mechanism.

Optionally, a tear bar 112 may be located on the base 102. Also optionally, a head piece 110 may be located at the end of the rod opposite the spinner 106. The head piece 110 is sized to fit loosely within a roll or tube of the type used for paper, plastic or foil goods supplied in rolled sheets to stabilize the roll or tube on the rod.

Figure 2A:
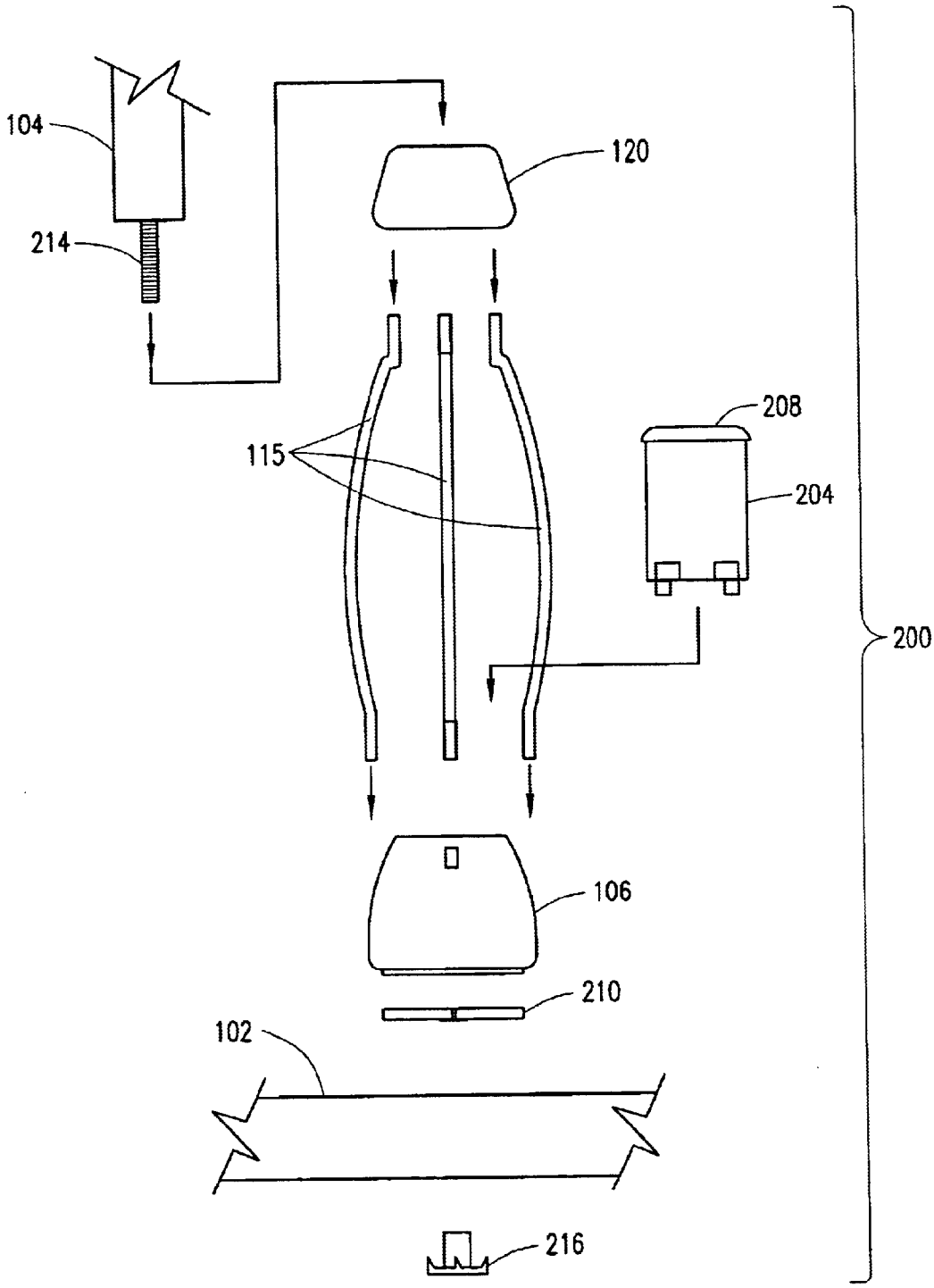
FIG. 2A illustrates an exploded view of an embodiment of the rotation mechanism according to the current invention

Referring to FIG. 2A, an exploded view of an embodiment of the rotation mechanism 200 according to the current invention is shown. A rod 104 inserts into a sleeve 204. A spinner 106 is disposed on and freely rotatable about the sleeve 204. Preferably, a collar 208 is provided on the sleeve 204 for the purpose of retaining the spinner on the sleeve. A friction disc 210 is disposed between the sleeve 204 and the base 102. A screw stud 214 on the end of the rod 104 passes through apertures in the sleeve 204 and friction disc 210, and engages a retaining nut 216 within the base 102.

Figure 2B:
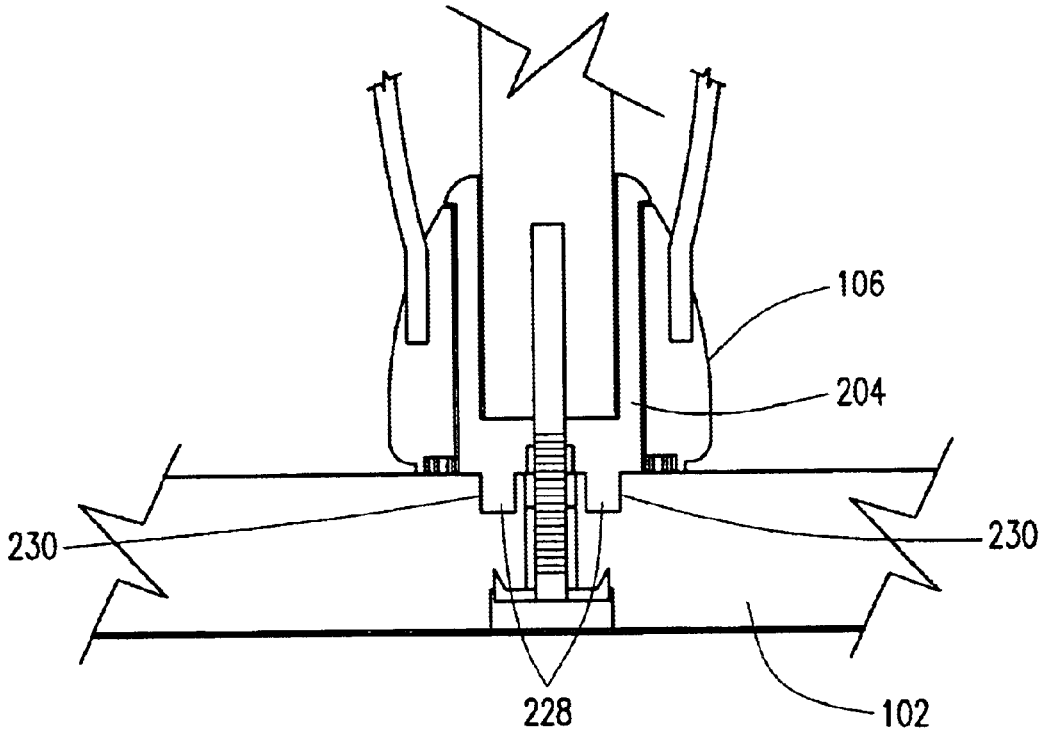
FIG. 2B illustrates a cross-section of the embodiment of the rotation mechanism assembled.

Referring to FIG. 2B, a cross-section of the embodiment of the spinner 106 is shown assembled. Preferably, the sleeve 204 is provided with rotation locks 228, which engage slots 230 in the base 102, preventing rotation of the sleeve.

Figure 3A:
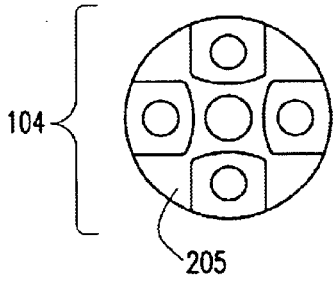
FIG. 3A illustrates a view of the bottom end of an embodiment of a sleeve according to the current invention.

Referring to FIG. 3A, a bottom view of the sleeve 104 according to the current invention is shown. The sleeve has a recessed area 205 in which the friction disc is situated.

Figure 3B:
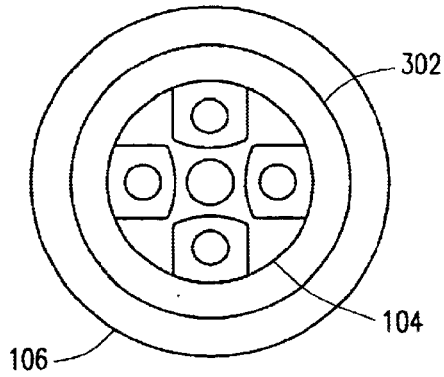
FIG. 3B illustrates a view of the bottom end of an embodiment of a spinner and sleeved assembled, according to the current invention.
Figure 3C:
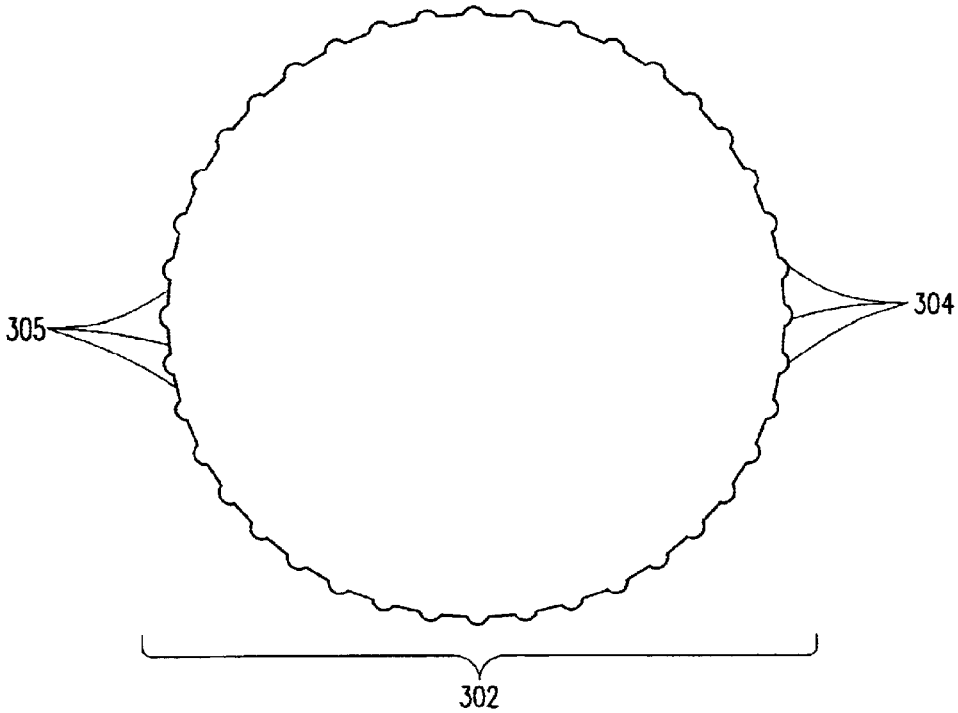
FIG. 3C illustrates a detailed view of the circumferential ridges shown in FIG. 3B.

Referring to FIG. 3B, a view of the bottom end of the said embodiment of a spinner 106 positioned on the sleeve 104 is shown. The spinner 106 is generally tubular in shape and may preferably be tapered at the head end as shown in FIGS. 2A and 2B. A concentric depression is defined by the circumference 302. The circumference 302 has a plurality of ridges 304 and divets 305 thereon. A detail of the circumference 302, ridges 304, and divets 305 is shown in FIG. 3C.

Figure 4A:
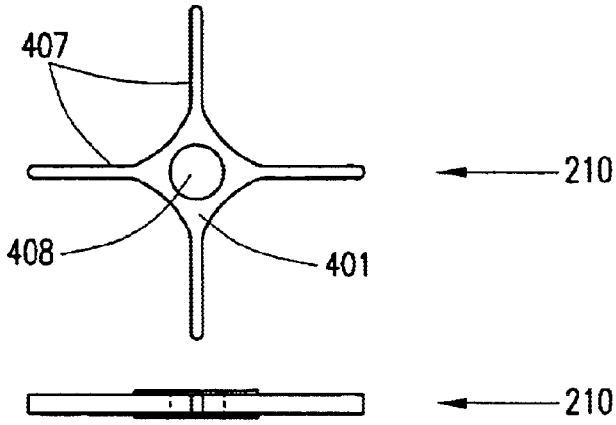
FIG. 4A illustrates views of the top and side of a preferred embodiment of a friction disc according to the current invention.

Referring to FIG. 4A, a top view and side view of one embodiment of a friction disc 210 according to the current invention is shown. Extending from a core 401 is a plurality of flexible protrusions 407. A centered aperture 408 allows the passage of the screw stud 214.

Figure 4B:
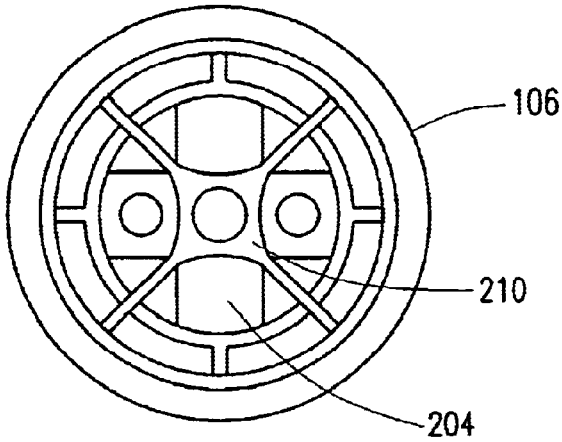
FIG. 4B illustrates a view of the bottom end of an assembled spinner, sleeve, and friction disc, according to the current invention.

Referring to FIG. 4B, a bottom view of the assembled spinner 106, sleeve 104, and friction disc 210 is shown. The friction disc 210 is disposed in the recessed area 205 of the sleeve 104 and remains stationary as the spinner 106 rotates. In this embodiment the friction disc is held stationary in the recessed area of the sleeve, said sleeve being held stationary by the rotation locks 228. The protrusions 407 of the friction disc can flex side to side in the plane of the friction disc as the said ridges 304 of the spinner engage the ends of the protrusions. The protrusions 407 are sized such that they loosely engage the divets 305 between the ridges 304 in the circumference 302. As the spinner 106 rotates, the protrusions 407 ride over the ridges 304 and flex sideways. This action allows desired quantities of material to be unwound from a roll of paper, plastic, foil or other rolled product. The action of the protrusions alternately riding over the ridges and engaging the divets creates a clicking sound as the spinner rotates. Once the desired quantity has been unwound, the resistance created by the engagement of the fingers in the divets allows the material to be removed from a roll without undesired material coming unraveled.

In an alternate embodiment of the invention, the rotation mechanism is sized and configured to snugly engage the inner surface of a roll or tube of the type used for paper, plastic or foil goods supplied in rolled sheets. The rotation mechanism may preferably have a plurality of flexible fingers. The flexible fingers aid in retaining the roll or tube on the rotation mechanism. In this embodiment the previously described flexible wires are omitted.

Figure 5B:
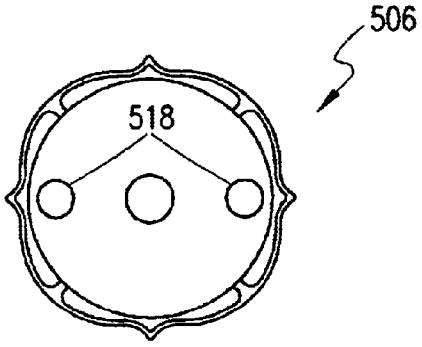
FIGS. 5A and 5B illustrates a top view and bottom view, respectively, of an alternate embodiment of the friction disc.
Figure 5A:
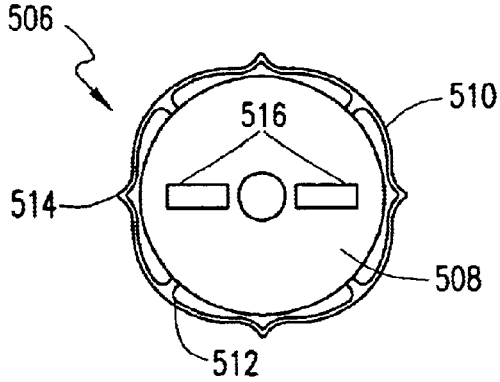

Referring to FIG. 5A, a perspective view of the top of an alternate embodiment of a friction disc 506 according to the current invention is shown. The body 508 of the friction disc 506 is generally circular and has a flexing ring 510 about its circumference. The flexing ring 510 has attachment points 512 to the body 508 in at least two places. Projections 514 are locating on the flexing ring such that the projections 514 can flex inward when a force is applied. Optionally, slots 516 for receiving the rotation locks from a sleeve, not shown, are located on the top surface of the friction disc 506. FIG. 5B shows a perspective view of the bottom of the friction disc 506, which is essentially identical to the top view with the exception that optionally rotation locks 518 are located on the bottom surface of the friction disc.

Figure 6:
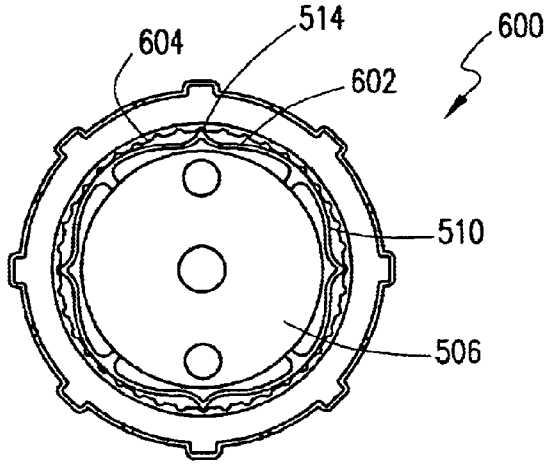
FIG. 6 illustrates a bottom view of an alternated embodiment of an assembled spinner, sleeve, and friction disc.

Referring to FIG. 6, an alternate embodiment of a spinner 600 is shown as a perspective view of the bottom end with an alternate embodiment of a friction disc 506 disposed within a concentric depression 602. The friction disc 506 and flexing ring 510 are sized such that such that the projections 514 loosely engage divets between ridges 604 in the circumference of the concentric depression 602. As the spinner 600 rotates the projections 514 ride over the ridges 604 as the flexing ring flexes inward. A friction and clicking action thereby results, similar to that in the preferred embodiment previously described.

Figure 7:
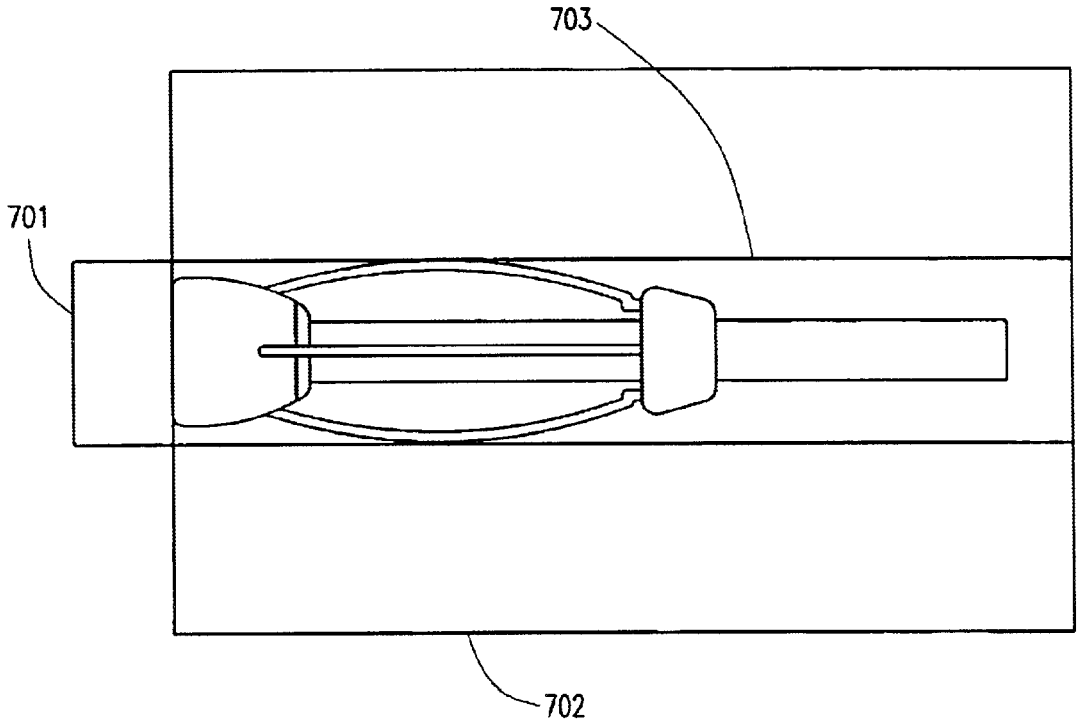
FIG. 7 illustrates a perspective view of an alternate embodiment of a dispenser, mounted horizontally, and incorporating a rotation mechanism according to the current invention.

Referring to FIG. 7, an alternate embodiment of the dispenser suitable for mounting horizontally on a wall is shown. A base 701 allows the horizontal mounting. Also shown is a roll of material to be dispensed 702 wrapped on a tube 703 and positioned on the dispenser.

Several embodiments of the invention have thus been described for illustrative purposes. However, those skilled in the art will recognize that the inventive dispenser disclosed can be configured in other ways not illustrated in the drawings.

According to an alternative embodiment of the invention, the dispenser can be oriented horizontally. Preferably in this alternative embodiment, the dispenser is configured for mounting on a wall. More preferably according to this embodiment, the dispenser further comprises a second base member wherein a tube or roll of goods is disposed between the two bases when the dispenser is in use. According to this embodiment, the dispenser may or may not include a rod or dowel disposed between the two bases. In the case that a rod is not included, the rotation mechanism may still be configured as shown in FIGS. 2A and 2B, with the exception that the rod 104 is not present. In this case, the screw stud 214 may be integral with the sleeve 204 or may be separate. Further, in this embodiment, the sleeve 204 may be hollow or a solid cylinder. In either alternative of this embodiment, the second base member will have a second spinner disposed thereon for engaging the interior surface of a tube or roll. The second spinner may or may not comprise part of a second rotation mechanism according to the current invention. Preferably, the second spinner does not comprise part of a second rotation mechanism, but instead rotates freely without a friction disc.

Those skilled in the art will recognize that the novel rotation mechanism of the current invention can be incorporated into various dispensers for a variety of household and other products that are supplied as rolled sheets on tubes or rolls. Examples of such household and other products include, but are not limited to paper towels, toilet paper, plastic wrap, shrink wrap, aluminum and tin foil, wax paper and gift-wrapping paper. All of these embodiments are considered to be within the scope of the current invention. Those skilled in the art will be able to ascertain the scope of the invention by the claims appended hereto.

What is claimed is:

1. A dispenser for a product supplied as a rolled sheet on a tube or roll, said dispenser comprising:

a rod having a first end and a second end, said rod having an axial screw stud at said first end;

a sleeve disposed on said first end of said rod, said sleeve having an upper end and a lower end, said upper end having a circumferential collar;

a spinner disposed on and being freely rotatable about said sleeve, said spinner having a head end and a bottom end, said head end contacting said collar such that said spinner is retained on said sleeve, and said bottom end having a concentric depression therein, said concentric depression having a plurality of circumferential ridges;

a fiction disc disposed on said axial screw stud and within said concentric depression such that said spinner is retained on said sleeve; and a first base member, said rod being joined to said first base member by said screw stud engaging a retaining nut in said first base member.

2. The dispenser according to claim 1 in which said lower end of the sleeve has a recessed area.

3. The dispenser according to claim 2 in which said friction disc is disposed within said recessed area, said friction disc having a core and a plurality of protrusions extending form the core, said protrusions loosely engaging said plurality, of circumferential ridges such that when said spinner rotates said plurality of protrusions contact said plurality of ridges, slowing said rotation.

4. The dispenser according to claim 3 further comprising:

a cap located on said rod toward the end of the rod opposite the location of said spinner; and a plurality of flexible wires, each having a first end and a second end, each connected to said cap at said first end and connected to said spinner at said second end, each of said wires being bowed outward in order to closely engage the inside of said tube or roll.

5. The dispenser according to claim 4, wherein:

said sleeve further comprises at least one rotation lock, said at least one rotation lock engaging at least one notch in said first base member.

6. The dispenser according to claim 5, further comprising:

a head piece attached to said second end of said rod; and a tear bar.

7. The dispenser according to claim 1, wherein said spinner is sized and dimensioned to closely engage the inner surface of a tube or roll used for rolled sheet products.

8. The dispenser according to claim 7 wherein said spinner further comprises a circumferential surface and a plurality of flexible fingers disposed on said circumferential surface.

9. The dispenser according to claim 1 wherein said friction disc has a circumferential edge and a flex ring disposed about said circumferential edge, said flex ring having a plurality of raised projections thereon, said plurality of raised projections loosely engaging said plurality of circumferential ridges such that when said spinner rotates said plurality of raised projections contact said plurality of ridges, generating resistance to said rotation.

10. The dispenser according to claim 9 wherein said sleeve further comprises at least one first rotation lock, said at least one first rotation lock engaging at least one notch in said friction disc.

11. The dispenser according to claim 10 further comprising:

a washer disposed between said spinner and said friction disc.

12. The dispenser according to claim 10 wherein said friction disc further comprises at least one second rotation lock, said at least one second rotation lock engaging at least one notch in said base.

13. The dispenser according to claim 11 wherein said friction disc further comprises at least one second rotation lock, said at least one second rotation lock engaging at least one notch in said base.

14. The dispenser according to claim 7, further comprising:

a head piece attached to said second end of said rod; and a tear bar.

15. The dispenser according to claim 1, wherein said first base member is configured to support a roll of paper towels in a vertical orientation.

16. The dispenser according to claim 1, wherein said first base member is configured to support a roll of paper towels in a horizontal orientation.

17. The dispenser according to claim 16, further comprising a second base member, said second base member being removably joined to said second end of said rod.

18. The dispenser according to claim 17, wherein said first base member and said second base member are configured for mounting on a wall.

19. A rotation mechanism for use with a dispenser for household materials supplied as rolled sheets, said mechanism comprising:

a spinner, said spinner being generally tubular in shape, having a head end and a bottom end, and an axial bore therethrough, said bottom end having a concentric depression therein, said concentric depression having a plurality of circumferential ridges thereon;

a cylindrical sleeve member having a circumferential collar at an upper end thereof, said spinner being mounted on and freely rotatable about said cylindrical sleeve member; and a friction disc mounted coaxially on a lower end of said cylindrical sleeve member and disposed within said concentric depression such that said spinner is retained between said collar and said friction disc.

20. The rotation mechanism as in claim 19, wherein:

said friction disc has a core and a plurality of protrusions extending from said core, said protrusions loosely engaging said plurality of circumferential ridges such that when said spinner rotates said plurality of protrusions contact said plurality of ridges, generating resistance to said rotation.

21. The rotation mechanism as in claim 19, wherein said friction disc has a circumferential edge and a flex ring disposed about said circumferential edge, said flex ring having a plurality of raised projections thereon, said plurality of raised projections loosely engaging said plurality of circumferential ridges such that when said spinner rotates said plurality of raised projections contact said plurality of ridges, generating resistance to said rotation.

22. The rotation mechanism of claim 19 wherein said spinner is sized and dimensioned to closely to closely engage the inner surface of a tube or roll used for rolled sheet products.

23. The rotation mechanism of claim 22 wherein said spinner has a plurality of flexible fingers thereon.

24. The rotation mechanism as in claim 19 further comprising a washer disposed between said friction disc and said spinner.

25. The rotation mechanism as in claim 19, wherein said sleeve comprises at least one first rotation lock, said at least one first rotation lock engaging at least one notch in said friction disc.

26. A dispenser for a product supplied as a rolled sheet on a tube or roll, said dispenser comprising:

a first base member;

a sleeve having a circumferential collar, said sleeve being joined to said first base member by a screw stud engaging a retaining nut in said first base member;

a spinner disposed on and being freely rotatable about said sleeve, said first spinner having a head end and a bottom end, said head end contacting said collar such that said first spinner is retained on said sleeve, said bottom end having a concentric depression therein, said concentric depression having a, plurality of circumferential ridges; and a friction disc disposed on said axial screw stud and within said concentric depression such that said spinner is retained on said sleeve, said friction disc having a core and a plurality of protrusions extending from said core, said protrusions loosely engaging said plurality of circumferential ridges such that when said spinner rotates said plurality of protrusions contact said plurality of ridges, generating resistance to said rotation.

27. The dispenser as in claim 26 further comprising:

a second base member;

a cap; and a plurality of flexible wires, each having a first end and a second end, each connected to said cap at said first end and connected to said spinner at said second end, each of said wires being bowed outward in order to closely engage the inside of said tube or roll.

28. The dispenser according to claim 27 wherein said dispenser is configured for mounting on a wall.

29. A rotation mechanism for dispensing a product oriented on a roll, said rotation mechanism comprising:

a plurality of flexible wires for contacting an interior of the roll;

a freely rotating cap for receiving a first end portion of the plurality of flexible wires;

a freely rotating spinner for receiving a second end portion of the plurality of flexible wires; and a friction disc for providing resistance to the freely rotating spinner.

30. The rotation mechanism of claim 29, wherein the freely rotating spinner comprises a depression for receiving the friction disc, a surface of the depression including divets and ridges thereon.

31. The rotation mechanism of claim 29, wherein the friction disc comprises a plurality of protrusions for engaging the freely rotating spinner.

32. The rotation mechanism of claim 29, further comprising a stationary rod for extending through the cap and the spinner.

33. The rotation mechanism of claim 32, further comprising a stationary sleeve, oriented interior to the spinner, for receiving the stationary rod.

* * * * *